US006953515B2

(12) United States Patent
Boyd et al.

(10) Patent No.: US 6,953,515 B2
(45) **Date of Patent: *Oct. 11, 2005**

(54) APPARATUS AND METHOD FOR PROVIDING A SIGNAL PORT IN A POLISHING PAD FOR OPTICAL ENDPOINT DETECTION

(75) Inventors: John M. Boyd, Atascadero, CA (US); Michael S. Lacy, Pleasanton, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/460,502

(22) Filed: Jun. 11, 2003

(65) Prior Publication Data

US 2003/0205325 A1 Nov. 6, 2003

Related U.S. Application Data

(63) Continuation of application No. 10/016,883, filed on Dec. 12, 2001, now Pat. No. 6,599,765.

(51) Int. Cl.[7] ..... B24B 49/12; B24B 1/00

(52) U.S. Cl. ..... 156/345.16; 451/66

(58) Field of Search ..... 156/345.12, 345.13, 156/345.16, 345.25; 451/66; 216/85

(56) References Cited

U.S. PATENT DOCUMENTS 5,246,525 A * 9/1993 Sato ..... 156/345.12
5,433,651 A * 7/1995 Lustig et al. ..... 451/6
5,993,647 A * 11/1999 Huang et al. ..... 210/87
6,056,851 A * 5/2000 Hsieh et al. ..... 156/345.12
6,146,242 A * 11/2000 Treur et al. ..... 451/6
6,454,630 B1 * 9/2002 Tolles ..... 451/6
6,488,568 B1 * 12/2002 Treur et al. ..... 451/6
6,599,765 B1 * 7/2003 Boyd et al. ..... 438/16
6,623,331 B2 * 9/2003 Sevilla et al. ..... 451/6

FOREIGN PATENT DOCUMENTS

EP 0 738 561 A1 10/1996 ..... B24B/37/04
EP 0 824 995 A1 2/1998 ..... B24B/37/04
EP 1 108 501 A2 6/2001 ..... B24B/37/04

* cited by examiner

*Primary Examiner*—Parviz Hassanzadeh
*Assistant Examiner*—Sylvia R. MacArthur
(74) *Attorney, Agent, or Firm*—Martine Penilla & Gencarella, LLP

(57) ABSTRACT

A method and apparatus for providing a substantially constant environment in the cavity surrounding the optical pathway during the chemical mechanical planarization (CMP) operation is provided. In one embodiment, a system for planarizing the surface of a substrate is provided. The system includes a platen configured to rotate about its center axis. The platen supports an optical view-port assembly for assisting in determining a thickness of a layer of the substrate. A polishing pad disposed over the platen is included. The polishing pad has an aperture overlying a window of the optical view-port assembly. A carrier for holding the substrate over the polishing pad is also included. A cavity defined between the surface of the substrate and the window is included. A fluid delivery system adapted to provide a stable environment in the cavity during a chemical mechanical planarization (CMP) operation is included.

11 Claims, 6 Drawing Sheets

APPARATUS AND METHOD FOR PROVIDING A SIGNAL PORT IN A POLISHING PAD FOR OPTICAL ENDPOINT DETECTION

CROSS REFERENCE TO RELATED APPLICATION

This application is a continuation application of U.S. patent application Ser. No. 10/016,883, filed on Dec. 12, 2001 now U.S. Pat. No. 6,599,765, and entitled "APPARATUS AND METHOD FOR PROVIDING A SIGNAL PORT IN A POLISHING PAD FOR OPTICAL ENDPOINT DETECTION." The disclosure of this related application is incorporated herein by reference for all purposes.

BACKGROUND OF THE INVENTION

1. Field of the Invention

The invention relates generally to semiconductor manufacturing and more specifically to a method and apparatus for providing a stable environment for a signal transmitted to assist in determining the thickness of a layer of a semiconductor substrate.

2. Description of the Related Art

During semiconductor manufacturing, the integrated circuits defined on semiconductor wafers are manufactured by forming various layers over one another. As a result of the various layers disposed over one another a surface topography of the wafer becomes irregular. These irregularities become problems for subsequent processing steps, especially processing steps for printing a photolithographic pattern having small geometries. The cumulative effects of the irregular surfaces can lead to device failure and poor yields if the surface topography is not smoothed.

A common process for smoothing the irregularities is through chemical mechanical planarization (CMP). In general, CMP processes involve holding and rotating the wafer against a polishing pad with an abrasive liquid media (slurry) under a controlled pressure. A particular problem encountered during CMP operations is the determination that an endpoint has been reached i.e., a desired flatness or relative thickness of material remaining on or removed from the semiconductor wafer has been obtained. Prior art methods include removing the semiconductor wafer to manually inspect if the wafer as well as in-situ methods using laser interferometry to measure a wafer's dimensions.

In-situ methods such as laser interferometry require the ability to "see" the wafer through the polishing pad. FIG. 1 illustrates a prior art diagram of an in-situ apparatus for measuring a thickness of a layer of a wafer 102. Wafer 102 is supported in carrier 104. During CMP operations wafer 102 is pressed against pad 106 in the presence of a slurry to planarize the wafer 102. Pad 106 sits on top of platen 108. The carrier 104 rotates the wafer 102 around its axis as illustrated by arrow 116 and the platen rotates around its axis as illustrated by arrow 114. Laser 112 is positioned to view the wafer surface through window 110 as the platen 108 rotates. European Patent Nos. EP 0,738,561 A1 and EP 0,824,995 A1 discuss in detail a laser interferometer and are hereby incorporated by reference.

A problem encountered with in-situ monitoring of CMP operations is that the environment in the gap 118 between the wafer 102 and the window 110 is constantly changing due to the dynamic environment and the abrasive nature of the process. Slurry and residue from the wafer 102 and the pad 106 are all entrained in gap 118, as well as air bubbles from the turbulence. For example, at the initiation of the CMP process the gap 118 is filled with slurry having certain optical characteristics. However, as the wafer 102 is planarized the a percentage of residue from the wafer and pad in the slurry in gap 118 becomes greater over time. Hence, the optical characteristics of the slurry in gap 118 changes, which in turn has an impact on the thickness measurement since the endpoint detector was calibrated with a slurry or fluid in gap 118 with the initial optical characteristics. While the window 110 may be located at different heights within the pad, a gap 118 will always exist so that the window 110 does not come into contact with the wafer 102. U.S. Pat. No. 6,146,242 describes an optical endpoint window disposed under a window in the polishing pad and is hereby incorporated by reference.

The non-uniform environment in gap 118 also causes noise and interference for the wafer layer thickness measurement by a laser or other in-situ method. As a result of the varying background noise and the changed conditions from the calibration, the accuracy of the thickness measurement is restricted. Furthermore, between the switching of wafers there is downtime where the slurry or residue may dry up on the window. Consequently, a film may develop over the window from the slurry sitting stagnant for a period of time. Here again, the film creates a condition which invalidates the calibration of the laser and negatively impacts the accuracy of the thickness measurement. Ultimately, the inaccuracies resulting from the background noise or the changed calibration parameters translate into a thickness measurement which is not representative of the wafer being planarized which in turn leads to poor yields and even device failure.

In view of the foregoing, there is a need for an apparatus and device which provides a stable background environment for measuring the thickness of a layer of a semiconductor wafer during CMP operations.

SUMMARY OF THE INVENTION

Broadly speaking, the present invention fills these needs by providing an apparatus and method for providing a substantially constant environment in the cavity surrounding the optical pathway during the chemical mechanical planarization (CMP) operation. It should be appreciated that the present invention can be implemented in numerous ways, including as an apparatus, a system, a device, or a method. Several inventive embodiments of the present invention are described below.

In one embodiment, a system for planarizing the surface of a substrate is provided. The system includes a platen configured to rotate about its center axis. The platen supports an optical view-port assembly for assisting in determining a thickness of a layer of the substrate. A polishing pad disposed over the platen is included. The polishing pad has an aperture overlying a window of the optical view-port assembly. A carrier for holding the substrate over the polishing pad is also included. A cavity defined between the surface of the substrate and the window is included. A fluid delivery system adapted to provide a stable environment in the cavity during a chemical mechanical planarization (CMP) operation is included.

In another embodiment, a system for measuring the endpoint of a chemical mechanical planarization (CMP) operation is provided. The system includes a rotatable platen supporting a window transmissive to light. A polishing pad disposed over the platen and having an aperture overlying the window is included. A cavity defined between the window and the substrate is included, wherein the cavity is within the aperture. An endpoint detector, which includes a laser interferometer or a broadband spectrometer, adapted to apply a light beam directed at a surface of the semiconductor substrate through the window and the cavity is included. A fluid delivery system configured to purge the cavity with a fluid during the CMP operation is also included.

In yet another embodiment, a method for measuring a thickness of a layer of a semiconductor substrate during a chemical mechanical planarization (CMP) operation is provided. The method initiates with providing a platen with a window. Then, a polishing pad is disposed over the platen such that an aperture in the pad overlies the window. Next, an optical pathway from an optical endpoint detector through the window to a surface of the substrate is defined. Then, a stable environment in a cavity defined between the surface of the substrate and the window is maintained. Next, the substrate is subjected to the CMP operation. Then, the thickness of the layer of the semiconductor substrate is measured.

In still another embodiment, a method for minimizing interference during the in-situ thickness measurement of a semiconductor substrate for a chemical mechanical planarization (CMP) operation is provided. The method initiates with providing a rotatable platen having a window transmissive to light. Then, a polishing pad is disposed over the platen. Next, an aperture of the polishing pad is aligned over the window. Then, a cavity is defined above the window and below a surface of the substrate. Next, the cavity is purged with a fluid to maintain a substantially constant environment in the cavity. Then, the substrate is subjected to the CMP operation while purging the cavity.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, in which like reference numerals designate like structural elements.

DETAILED DESCRIPTION OF THE PREFERRED EMBODIMENTS

An invention is described for a method and apparatus which provides a substantially constant environment to accurately measure the thickness of a layer of a wafer during a chemical mechanical planarization (CMP) operation. It will be obvious, however, to one skilled in the art, that the present invention may be practiced without some or all of these specific details. In other instances, well known process operations have not been described in detail in order not to obscure the present invention.

The embodiments of the present invention provide an apparatus and method for maintaining a substantially constant environment in a cavity where an optical pathway traverses. The substantially constant environment minimizes any interference with in-situ thickness measurements of a wafer undergoing CMP. Additionally, by providing the stable environment, the conditions under which the in-situ end point detector is initially calibrated remain substantially constant throughout the CMP process. Therefore, as the CMP operation progresses, slurry residue and residue from the wafer and the polishing pad, which include particulates generated from the abrasive nature of CMP, are impeded from entering a cavity surrounding the optical pathway. As a result, the endpoint detection system, such as a fiber optic detection system, does not encounter a changing environment in the optical pathway. Hence, the accuracy of the thickness measurement of a layer of the substrate being planarized is improved due to the stable environment.

In one embodiment of the invention, the substantially constant environment is provided by a fluid dispensing system. In this embodiment, the fluid dispensing system dispenses a fluid, either a liquid or a gas, into the cavity from a fluid opening located at the bottom of the cavity. This creates an environment where fluid flows out of the cavity without impacting the CMP process. The purging of the cavity by the flow of the fluid prevents residues from the CMP process from entering the cavity. As will be explained in more detail below, the fluid is directed along a pathway through the platen similar to a fiber optic bundle for the interferometry detection system in one embodiment. A flow rate of the fluid to the cavity is regulated to provide the positive pressure necessary to prevent residues from entering the cavity. In addition, the fluid flow is maintained during breaks in the CMP operation, such as when switching out wafers, in order to eliminate slurry residue from forming a film over an optical view-port. As used herein, the optical view-port is referred to as a window.

Figure 1:
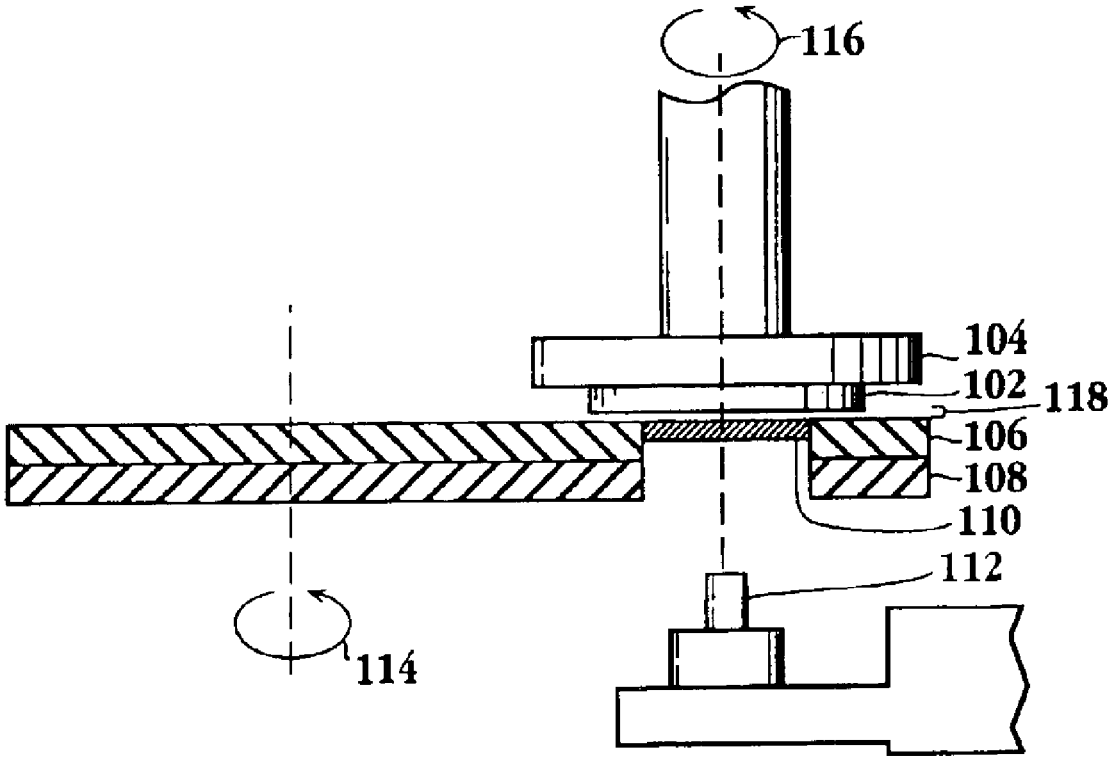
Fig. 1 (prior art)
FIG. 1 illustrates a prior art diagram of an in-situ apparatus for measuring a thickness of a layer of a wafer.
Figure 2A:
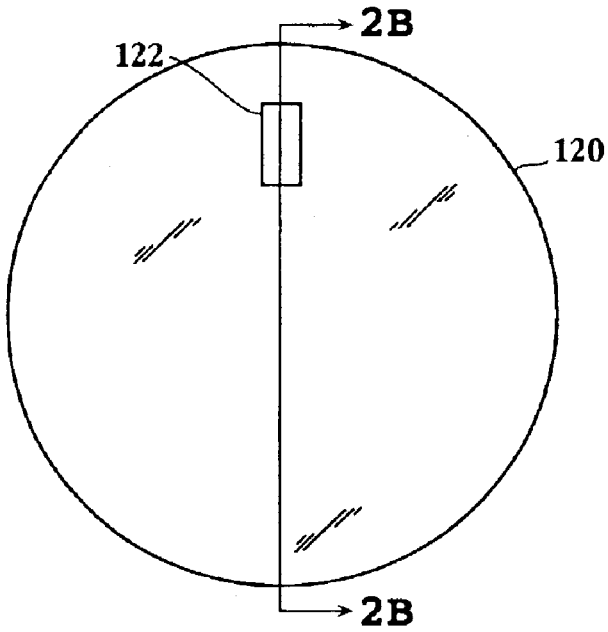
FIG. 2A illustrates a top view of a polishing pad having an aperture in accordance with one embodiment of the invention.

FIG. 2A illustrates a top view of a polishing pad 120 having an aperture 122 in accordance with one embodiment of the invention. Polishing pad 120 is formed from a porous material such as polyurethane in one embodiment. Aperture 120 provides access for a laser beam to the surface of a substrate undergoing the CMP operation. Thus, once per rotation of the pad 120 the aperture 122 will be underneath the wafer being planarized. In one embodiment, at the time the aperture 122 is below the wafer, the laser will impinge on the surface of the substrate through the aperture 122.

Figure 2B:
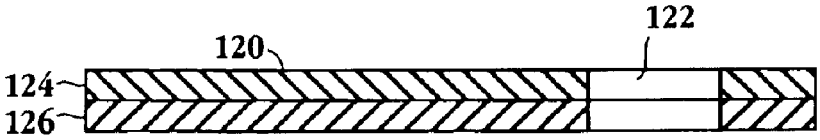
FIG. 2B illustrates a side view of pad in accordance with one embodiment of the invention.

FIG. 2B illustrates a side view of pad 120 in accordance with one embodiment of the invention. A top layer 124 of polishing pad 120 is affixed to a bottom layer 126. In one embodiment, a pressure sensitive adhesive is used to affix the top layer 124 to the bottom layer 126. Aperture 122 extends through top layer 124 and bottom layer 126. In one embodiment the aperture is formed by a slit in the polishing pad 120. In one embodiment, the aperture is between about 10 millimeters (mm) and about 100 mm in length and between about 1 mm and 10 mm in width.

Figure 3:
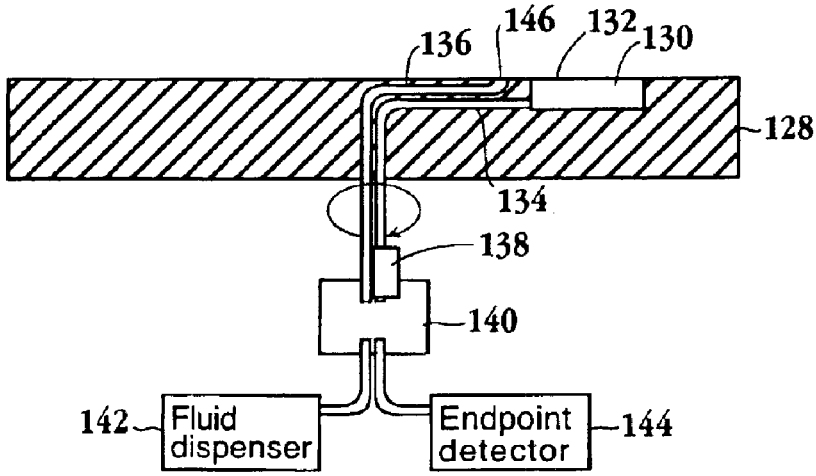
FIG. 3 illustrates a side view of a platen configured to provide a substantially constant local environment near a window for an endpoint detection system in accordance with one embodiment of the invention.

FIG. 3 illustrates a side view of a platen 128 configured to provide a substantially constant local environment near a window 132 for an endpoint detection system in accordance with one embodiment of the invention. Platen 128 is rotatable around its axis in one embodiment. Optical fiber bundle 134 is routed from optical sensor 130 inwardly and radially toward the center of the platen 128 and downwardly to an optical-electrical converter 138 in one embodiment. In this embodiment optical fiber bundle 134 is routed along a drive spindle (not shown) of the platen 128. In another embodiment, fluid delivery line 136 is adjacent to optical fiber bundle 134 and dispenses a flow of fluid through fluid delivery opening 146 of the window 132. Fluid delivery line 136 is routed through the platen 128 from opening 146 of window 132 inwardly and radially toward the center of the platen 128 and downwardly to a fluid dispenser 142. In this embodiment fluid delivery line 136 is routed along drive spindle (not shown) of the platen 128.

In the embodiment illustrated in FIG. 3, slip ring 140 is supplied so that the components above slip ring 140 rotate with the platen around its axis while the components below slip ring 140 are stationary. In another embodiment, fluid dispenser 142, which sits stationary, dispenses a gas or liquid through fluid delivery line 136 to a top surface of the platen 128. Here, the fluid is directed from a location adjacent to sensor window 132 on the surface of platen 128. In one embodiment, the pad of FIGS. 2A and 2B is disposed over the platen 128 such that aperture 122 is overlying sensor window 132 and fluid delivery opening 146. In this embodiment, a cavity between the sensor window 132 and a surface of the wafer against the polishing pad is filled from the bottom-up with fluid supplied through fluid delivery opening 146. The flow rate of the fluid is adjusted so that a positive pressure is maintained in the cavity and the fluid will flow out of the aperture 122 at a low flow rate. The low flow rate prevents residue from the abrasive CMP operations as well as the slurry from entering the cavity between the wafer and the sensor window 132. At the same time, the flow rate of the fluid is not strong enough to perturb the wafer planarization process. Additionally, the flow rate of a liquid or gas through the cavity prevents air bubbles from the optical path way between the sensor window 132 and the surface of the wafer to which the laser beam is directed. Furthermore, by keeping the cavity wet, slurry is prevented from drying over the sensor window 132, especially during idle times, such as changing wafers. It should be appreciated that aperture 132 may also be referred to as a slit in polishing pad 120.

In one embodiment of the invention illustrated in FIG. 3, the fluid is a liquid such as de-ionized water (DIW), pH-adjusted water to correspond to the slurry pH (i.e. approximately 10.5) or is comprised of the supernatant liquid of the polishing slurry. The supernatant could be produced by in-situ filtering of a small portion of the slurry being used, for example. In another embodiment, the fluid is a gas, such as a vapor, which will not dry out the slurry. The fluid delivery system includes a pump connected to a reservoir of liquid in one embodiment. In still another embodiment, the fluid delivery system is a flow meter connected to a gas supply. In yet another embodiment, the fluid delivery system is a tee-off of the existing slurry delivery line, with the shunted liquid being filtered to remove the abrasive particles prior to delivery to the aperture. As mentioned above, endpoint detector 144 includes a laser interferometer or broad-band spectrometer capable of generating a beam of laser or broad-spectrum light directed towards a semiconductor substrate undergoing CMP processing and detecting reflected light from the wafer in one embodiment. As the platen 128 is rotating about its center axis, the window 132 has a view of the wafer surface once per rotation in one embodiment. Accordingly, the signals from the laser interferometer are synchronized so that the samples are taken as the laser beam impinges on the surface of the substrate through the aperture 122 during each rotation of the platen 128.

Figure 4:
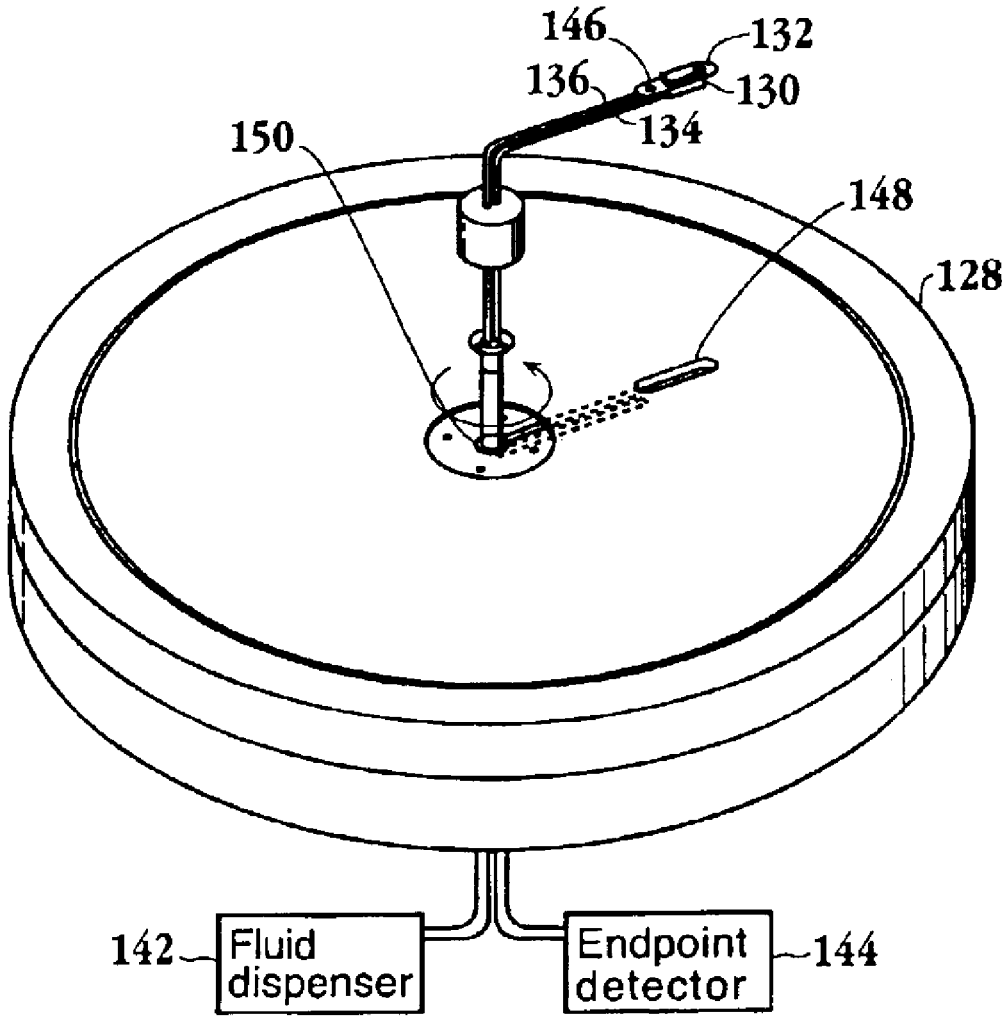
FIG. 4 illustrates an elevated view of the fluid delivery line and optical fiber bundle of the platen in accordance with one embodiment of the invention.

FIG. 4 illustrates an elevated view of the fluid delivery line 136 and optical fiber bundle 134 of platen 128 in accordance with one embodiment of the invention. Optical sensor 130 is designed to fit in recess 148 of platen 128. In one embodiment, the vertical height of window 132 is adjustable over the surface of platen 128. In this embodiment, the distance between the surface of the wafer and the top of the window is between about 10 mils and about 35 mils As illustrated in FIG. 4, fluid delivery line 136 and optical fiber bundle 134 are adjacent to each other and run under the surface of the platen 128 inwardly and radially to a center aperture 150 of the platen 128. Fluid delivery line 136 and optical fiber bundle 134 then proceed downward through an optoelectronic transducer and finally an electrical slip ring 140 not shown (in the case of the fiber optic bundle,) and through a rotary union to fluid dispenser 142 and endpoint detector 144, respectively. It should be appreciated that while FIGS. 3 and 4 illustrate optical fiber bundle 134 and fluid delivery line 136 coupled to each other, these illustrations are exemplary and not meant to be limiting. In another embodiment, there are a plurality of fluid delivery openings 146 distributed over window 132.

While the sensor array for sending the laser beam and receiving the reflected laser beam is illustrated as part of platen 128 of FIG. 4, the array can also be located below the platen 128 in a position that does not rotate with platen 128. In this embodiment, the laser beam is synchronized to view the surface of the wafer being planarized as the platen 128 rotates. Furthermore, while FIG. 4 illustrates paths for optical fiber bundle 134 and 134 and fluid delivery line 136 adjacent to each other, these paths are exemplary and not meant to be limiting. For example, the optical fiber bundle may not proceed through the platen 128 as mentioned above.

Figure 5:
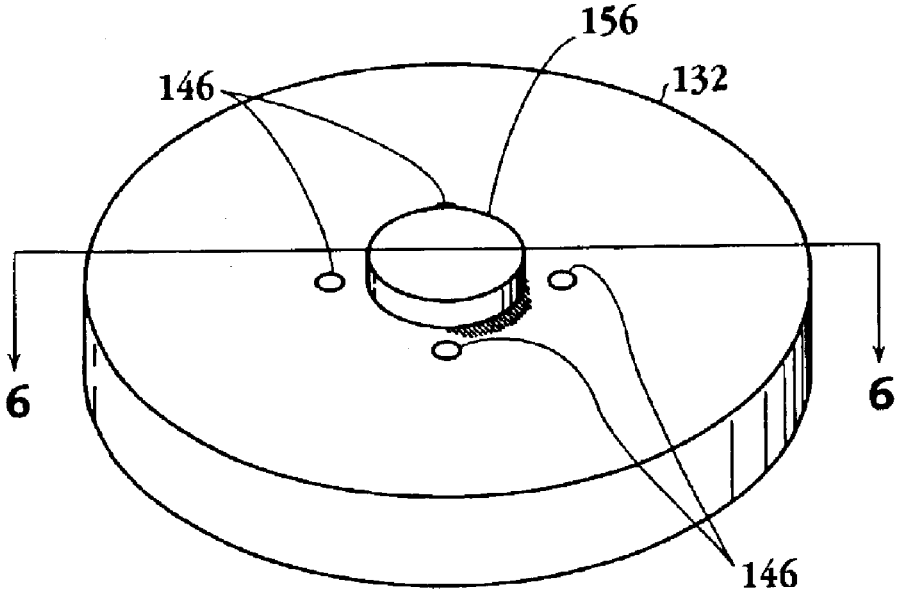
FIG. 5 illustrates a top view of the window in accordance with one embodiment of the invention.

FIG. 5 illustrates a top view of the window 132 in accordance with one embodiment of the invention. Window 132 has a plurality of fluid delivery openings 146 distributed through window 132. As illustrated in FIG. 5, the plurality of fluid delivery openings 146 are separate from a raised portion 156 of window 132. In one embodiment, the optical pathway from the optical sensor 130 through the raised portion of window 132 to the wafer 102. While FIG. 5 illustrates a window 132 of a circular shape, it should be appreciated that the window can be any shape. Additionally, the window 132 can have any number of fluid delivery openings 146, i.e., single or multiple openings, distributed in any pattern over the window 132.

Figure 6:
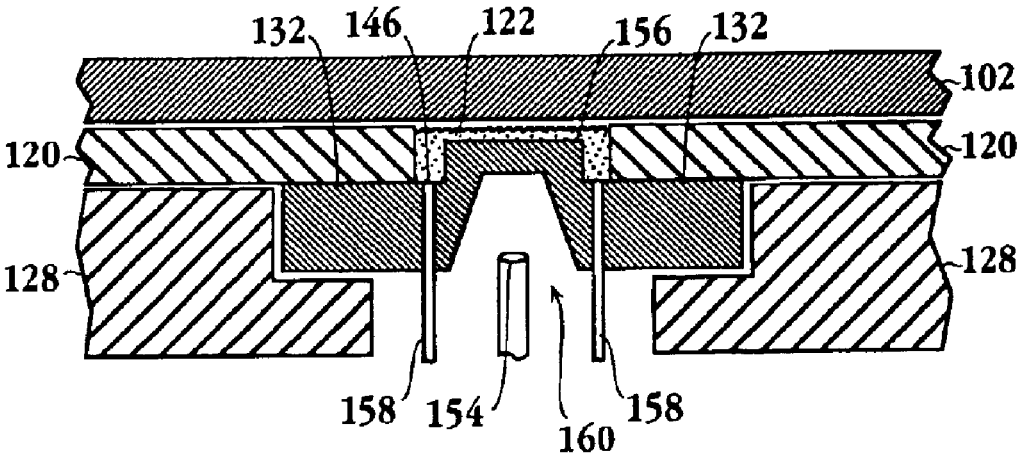
FIG. 6 illustrates a cross sectional view of the window in accordance with one embodiment of the invention.

FIG. 6 illustrates a cross sectional view of window 132 in accordance with one embodiment of the invention. Wafer 102 is pressed against pad 120 during CMP operations. Pad 120 has aperture 122 configured to accommodate window 132. In one embodiment, the raised portion 156 of window 132 is accommodated by aperture 122 in pad 120. In another embodiment, the top of raised portion 156 of window 132 is slightly below the height of pad 120. Therefore, as the wafer 102 is pressed against pad 120 during CMP operations the raised portion 156 of window 132 will not come in contact with wafer 102. In one embodiment, window 132 is supported by a recess in platen 128. Laser interferometer sensor 154 is enclosed in hollow section 160 below window 132. In another embodiment, one of the laser interferometer sensor 154 is a component of optical sensor 130. As mentioned above broadband spectrometry can be used in place of laser interferometry. Fluid delivery openings 146 are adjacent to raised portion 156 of window 132. A fluid from fluid dispenser 142 is delivered through fluid delivery line 136 and into fluid delivery extensions 158. In one embodiment, multiple fluid delivery extensions 158 are in communication with fluid delivery line 136. In the embodiment for a single fluid delivery opening 146, a single fluid delivery extension 158 is employed.

As illustrated in FIG. 6, the fluid delivered from fluid delivery openings 146 flows into a cavity defined between the window 132 and the surface of the wafer 102 undergoing a CMP operation. The flow of fluid fills the cavity from the bottom of the cavity near fluid delivery opening 146 to the top of the cavity near the surface of the wafer undergoing the CMP operation. A positive flow rate is maintained in the cavity to prevent process slurry from entering the cavity and maintain a stable environment in the cavity. The flow rate of the fluid is maintained at a rate which does not perturb the CMP operation but is capable of preventing slurry and residues from entering the cavity. Accordingly, a substantially constant environment is maintained in the cavity for the optical pathway from the window 132 and the surface of the wafer 102. Consequently, the calibration conditions, under which the end point detector 144 is initialized, remain substantially constant, which in turn provides for a more accurate thickness measurement of the wafer 102 throughout the CMP process. In one embodiment, the pad 120 is affixed to the platen 128 by an adhesive. The adhesive acts as a seal to prevent the fluid from flowing between the pad 120 and the platen 128.

Figure 7:
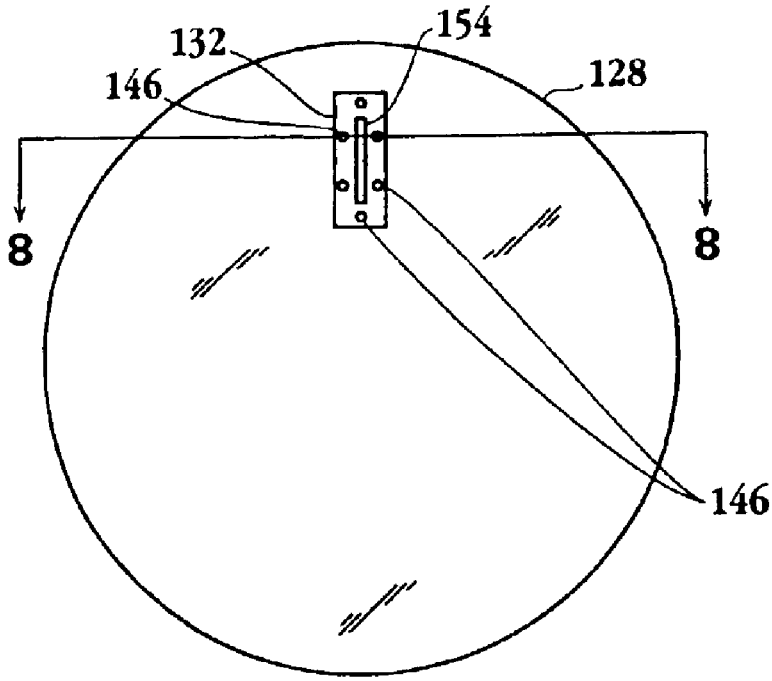
FIG. 7 illustrates a top view of an alternative embodiment of a window supported by a platen in accordance with one embodiment of the invention.

FIG. 7 illustrates a top view of an alternative embodiment of a window 132 supported by a platen 128 in accordance with one embodiment of the invention. Window 132 is rectangular and supported by a recess in platen 128. Fluid delivery openings 146 are distributed around window 132 to provide access for a fluid into a cavity 162 defined above window 132. Laser interferometer sensor 154 resides below window 132. Of course window 132 can take on any shape and is not limited by the circular or rectangular shapes of FIGS. 5 and 7.

Figure 8:
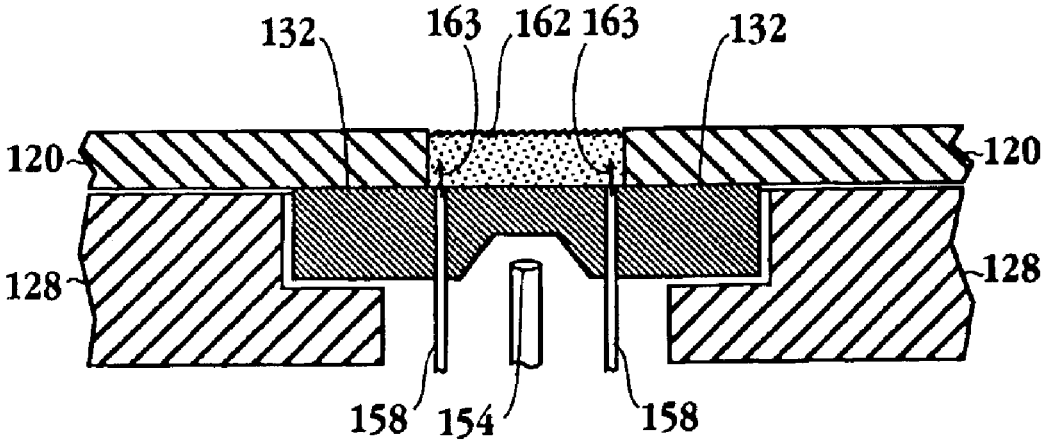
FIG. 8 illustrates an enlarged cross sectional view of a window of FIG. 8 in accordance with one embodiment of the invention.

FIG. 8 illustrates an enlarged cross sectional view of window 132 of FIG. 8 in accordance with one embodiment of the invention. In this embodiment, the cavity 162 between the window 132 and the surface of the wafer to be planarized (not shown) is filled with fluid. As indicated by arrows 163, the fluid flows from fluid delivery extension lines 158 from the bottom of the cavity 162 to the top of cavity 162. Fluid delivery openings 146 on window 132 introduce the fluid into cavity 162. It should be appreciated that cavity 162 corresponds to aperture 122 of FIG. 2A. As mentioned above aperture 122 in pad 120, which defines the side boundaries of cavity 162, is a slit in the pad 120 sufficient to allow a laser beam from laser interferometer 154 to pass through in addition to allowing a reflected laser beam from the wafer surface to return to the interferometer 154. It should be appreciated that while a plurality of fluid delivery extension lines 158 are illustrated, a single line can also be used.

The flow of fluid from the fluid delivery extension lines 158 of FIG. 8 maintains a positive flow rate so that residue and slurry from the CMP operation is prevented from entering the cavity 162. Therefore, the optical pathway from laser interferometer 154 to the surface of the wafer, remains substantially constant i.e., substantially free of residue and slurry. As slurry and residue tend to scatter light and thus attenuate the light emitted from interferometer 154, the thickness measurement determined through laser interferometry becomes much more accurate and reliable. It should be appreciated that in one embodiment laser interferometer 154 is replaced with a broadband spectrometer as an end point detector for the planarization process. Window 132 is illustrated as a flat surface without a raised portion, however, window 132 can include a raised portion so that a distance from the top of the window 132 to the surface of the wafer being planarized is at a minimum. As referred to above, the fluid delivered to cavity 162 may be a liquid such as DI water, pH-adjusted water to correspond to the slurry pH or is comprised of the supernatant liquid of the polishing slurry. The supernatant could be produced by in-situ filtering of a small portion of the slurry being used, for example. In another embodiment, the slurry pH is about 10.5. Here the pH-adjusted water is adjusted to a pH of about 10.5 through the addition of potassium hydroxide (KOH) or ammonium hydroxide ($NH_4OH$). In the embodiment where a liquid is used, the flow rate of the liquid creates a slightly positive pressure in the cavity preventing slurry and residue from entering. Where a gas, which will not dry out the slurry, is used as the fluid, the flow rate of gas into the cavity creates a slightly positive pressure in the cavity preventing slurry and residue from entering.

Figure 9:
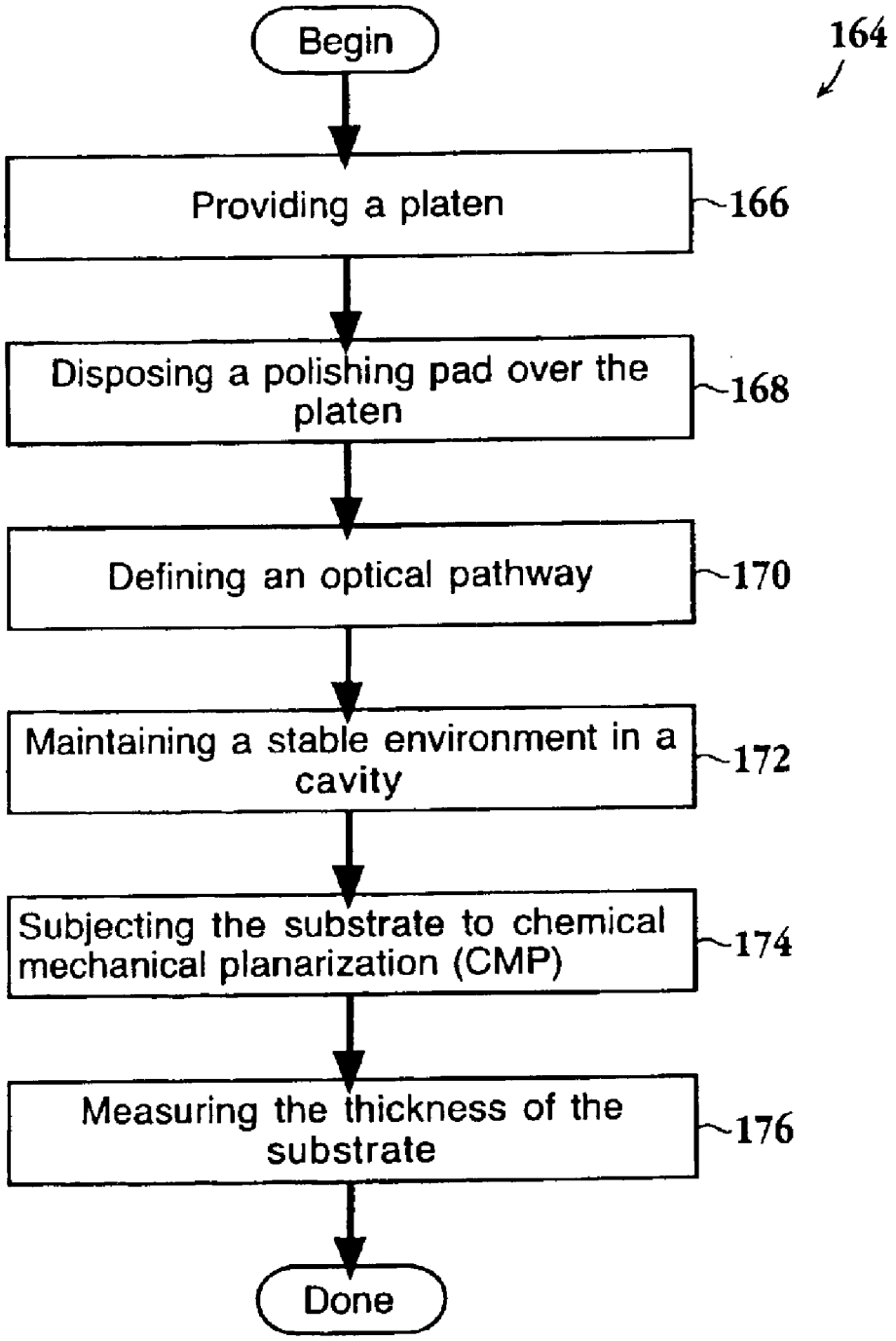
FIG. 9 illustrates flowchart depicting a method for measuring the thickness of a layer of a semiconductor substrate during a CMP operation.

FIG. 9 illustrates flowchart 164 depicting a method for measuring the thickness of a layer of a semiconductor substrate during a CMP operation. The method initiates with operation 166 where a platen with a window is provided. In one embodiment, the window allows access for a signal from a sensor of an in-situ endpoint detector as the platen rotates around its axis. The in-situ endpoint detector is a fiber optic detector such as a laser interferometer in one embodiment. The method advances to operation 168 where a polishing pad is disposed over the platen. In another embodiment the polishing pad includes an aperture as described with reference to FIGS. 2A, 2B, 6 and 7. It should be appreciated that for a laser interferometer, the aperture in the pad needs to accommodate a laser beam directed toward the surface of the substrate undergoing the CMP operation. Therefore, a slit in the pad will provide the access in one embodiment.

Continuing with flowchart 164, the method then proceeds to operation 170 where an optical pathway is defined. The optical pathway initiates from a sensor of the laser interferometer through a sensor window, through a cavity filled with fluid and to a surface of the substrate undergoing a CMP process in one embodiment as described with reference to FIG. 6. The laser interferometer sensor is established within the platen so that it rotates with the platen in one embodiment. Of course, the laser interferometer can be replaced with a broadband spectrometer. In another embodiment, the sensor is established below the platen and stays stationary as the platen rotates. The method then moves to operation 172 where the where a stable environment is maintained in the cavity. As mentioned above and in reference to FIGS. 6 and 8, a cavity is defined between the window of the platen on the bottom, the surface of the substrate on the top and the sides of the cavity corresponding to the sides of the aperture. The stable environment is provided by a fluid dispenser adapted to provide a fluid to the cavity in order to prevent residue from the abrasive nature of the CMP process. In one embodiment, the fluid is delivered to the cavity through a fluid delivery line disposed in the platen. In another embodiment, the fluid is delivered to the bottom of the cavity. Thus, the flow of the fluid fills the cavity from the bottom-up and thereby creates a stable environment for the optical pathway through the cavity. As mentioned above, the fluid can be a gas or a liquid compatible with the CMP operation.

The method of flowchart 164 then moves to operation 174 where the substrate is subjected to the CMP operation. Here, a pressure is applied to the substrate to press the substrate against the pad in the presence of a slurry in order to planarize the wafer. Then, the method proceeds to operation 176 where the thickness of a layer of the substrate is measured. For example, the thickness of an oxide layer which is being planarized is measured to determine an endpoint of the planarization operation. In one embodiment, the thickness of the amount of material removed from the layer, such as an oxide or copper layer is determined. In another embodiment, where the in-situ endpoint detection is performed by one of laser interferometry or broadband spectometry, a light beam is directed toward the surface of the wafer being planarized. Here, the optical pathway of the laser proceeds through the cavity. Since the cavity is being purged with a fluid during the CMP operation, the optical characteristics of the optical path remain substantially constant. Therefore, any changes during CMP operation are due to the film being removed from the wafer during the CMP process. Accordingly, the conditions under which the laser interferometer, or any fiber optic endpoint detector such as a broadband spectrometer, is initially calibrated do not substantially change during the CMP operation, except from the changes introduced by the removal of the film during wafer polishing, and thus increasing signal-to-noise of the endpoint signal. In consequence to the stable environment, interference and background noise are minimized resulting in a more accurate thickness measurement. Furthermore, the fluid delivery system is capable of purging the cavity during periods where the semiconductor substrate is being changed out, or the system is placed in idle or standby mode for a short period of time. Slurry residue is therefore prevented from drying up on the window i.e., a film is prevented from forming on the window, which would change the optical characteristics through the cavity.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A system for planarizing a surface of a substrate, the system comprising:

a polishing pad disposed over a platen, the polishing pad having an aperture defined therethrough;

a cavity defined below the surface of the substrate, when the substrate is disposed over the aperture; and a fluid delivery system adapted to provide a stable environment in the cavity during the chemical mechanical planarization (CMP) operation, the fluid delivery system is configured to provide a fluid to the cavity.

2. The system of claim 1, wherein the fluid delivery system delivers a flow of fluid to a bottom of the cavity through a fluid delivery line to maintain a filled cavity.

3. The system of claim 1, wherein the fluid delivery system includes a pump in communication with a reservoir of de-ionized water.

4. The system of claim 1, wherein the fluid delivery system includes a flow meter to control a gas flow to the cavity through a fluid delivery line.

5. The system of claim 1, wherein optical characteristics of the stable environment in the cavity remain substantially constant throughout the CMP operation.

6. A system for measuring an endpoint of a chemical mechanical planarization (CMP) operation, the system comprising:

a polishing pad disposed over a platen, the polishing pad having an aperture defined therethrough;

a cavity defined below the substrate, the cavity within the aperture;

an endpoint detector including one of a laser interferometer and a broadband spectrometer adapted to apply a light beam directed at a surface of the semiconductor substrate through the cavity; and a fluid delivery system configured to fill the cavity with a fluid during the CMP operation.

7. The system of claim 6 further comprising:

a window defined within the platen, the window having a raised portion adapted to fit in the cavity.

8. The system of claim 6 wherein the fluid delivery system transfers fluid to the cavity through fluid delivery lines, the fluid delivery lines defining a path from a bottom of the cavity radially inward toward a center of the platen, through a platen drive spool and a slip ring and to the fluid delivery system.

9. The system of claim 6 wherein the fluid delivery system fill the cavity with one of a gas and a liquid.

10. The system of claim 6 wherein filling of the cavity maintains a flow rate from a bottom of the cavity to a top of the cavity to prevent process slurry from entering the cavity.

11. The system of claim 10 wherein filling maintains a substantially constant environment having substantially constant optical characteristics throughout the CMP operation.

* * * * *